US008674921B2

(12) United States Patent
Lin

(10) Patent No.: US 8,674,921 B2
(45) Date of Patent: Mar. 18, 2014

(54) LIQUID CRYSTAL DISPLAY MONITOR CAPABLE OF AUTOMATICALLY SWITCHING DISPLAY MODE AND THE CONTROL METHOD THEREOF

(75) Inventor: Sheng-Yueh Lin, Taipei (TW)

(73) Assignee: MStar Semiconductor, Inc., ChuPei, Hsin-Chu Hsien (TW)

( * ) Notice: Subject to any disclaimer, the term of this patent is extended or adjusted under 35 U.S.C. 154(b) by 2158 days.

(21) Appl. No.: 11/556,700

(22) Filed: Nov. 5, 2006

(65) Prior Publication Data

US 2007/0296656 A1 Dec. 27, 2007

(30) Foreign Application Priority Data

Jun. 23, 2006 (TW) ..... 95122621 A

(51) Int. Cl.
*G09G 3/36* (2006.01)

(52) U.S. Cl.
USPC ..... 345/94; 345/208

(58) Field of Classification Search
USPC ..... 348/14.01–14.16, 21–844; 345/1.1–111, 156–184, 204–215, 345/690–699
See application file for complete search history.

(56) References Cited

U.S. PATENT DOCUMENTS

| | | | | |
|---|---|---|---|---|
| 5,089,811 | A * | 2/1992 | Leach | 345/636 |
| 5,640,171 | A * | 6/1997 | Shimada | 345/8 |
| 6,057,889 | A * | 5/2000 | Reitmeier et al. | 348/555 |
| 6,657,622 | B2 * | 12/2003 | Park | 345/205 |
| 7,363,575 | B2 * | 4/2008 | Chung | 714/759 |
| 7,428,647 | B2 * | 9/2008 | Price et al. | 713/300 |
| 2005/0237316 | A1 * | 10/2005 | Huang et al. | 345/204 |
| 2006/0152463 | A1 * | 7/2006 | Furihata et al. | 345/98 |
| 2007/0064941 | A1 * | 3/2007 | Unger et al. | 380/210 |

* cited by examiner

*Primary Examiner* — Gene W Lee
(74) *Attorney, Agent, or Firm* — Winston Hsu; Scott Margo

(57) ABSTRACT

An LCD monitor capable of automatically switching display mode, the corresponding control method and the controller for controlling the LCD monitor are provided. The LCD monitor includes a digital signal receiver, a signal certification unit, an image processor, and an LCD panel. The digital signal receiver receives a digital image signal. The signal certification unit which is coupled to the digital signal receiver determines if the digital image signal conforms to a protocol and generates a control signal. The image processor which is coupled to the digital signal receiver and the signal certification unit determines the display mode of the LCD monitor according to the control signal and processes the digital image signal according to the display mode to generate an output image signal. The LCD panel which is coupled to the image processor displays the image contents of the output image signal.

10 Claims, 2 Drawing Sheets

LIQUID CRYSTAL DISPLAY MONITOR CAPABLE OF AUTOMATICALLY SWITCHING DISPLAY MODE AND THE CONTROL METHOD THEREOF

CROSS REFERENCE TO RELATED APPLICATIONS

This application claims the benefit of Taiwan application Serial No. 95122621, filed Jun. 23, 2006, the subject matter of which is incorporated herein by reference.

BACKGROUND OF INVENTION

1. Field of the Invention

The invention relates in general to a liquid crystal display (LCD) monitor, and more particularly to an LCD monitor capable of automatically switching display mode and the control method thereof. A controller to control the LCD monitor is also disclosed.

2. Description of the Prior Art

Nowadays liquid crystal display (LCD) monitors have become the main stream products in the computer monitor market. For the individual need of every consumer, almost all LCD monitors provide the control function "On Screen Display (OSD)" to allow users to adjust some display characteristics of the LCD monitor, such as the brightness value, the contrast value, the hue value, and etc. Moreover, for the sake of convenience, some LCD monitors further have a number of predetermined display modes, for instance, a text mode, a picture mode, a video mode, a game mode, etc. Each display mode specifies the setting values of the display characteristics such as the brightness value, the contrast value, and the hue value, each of which has been adjusted in advance to a best condition for the corresponding display mode. Therefore, the LCD monitor with such design may reach its best performance in each display mode, and thereby users will have a very good experience in using such monitors. However, the fact that users must manually switch the display mode whenever the display contents change causes great inconvenience, and thus the LCD monitor would probably not be brought into best performance because the user may forget to switch the display mode after a long-term use.

SUMMARY OF INVENTION

It is therefore an object of the invention to provide an LCD monitor capable of automatically switching display mode and the control method thereof. The LCD monitor of the present invention decides whether to automatically switch the display mode or not by determining if an image signal conforms to an authentication protocol.

According to an embodiment of the claimed invention, an LCD monitor capable of automatically switching display mode is disclosed. The LCD monitor includes a digital signal receiver, a signal certification unit, an image processor, and an LCD panel. The digital signal receiver receives a digital image signal. The signal certification unit which is coupled to the digital signal receiver determines if the digital image signal conforms to a protocol and generates a control signal. The image processor which is coupled to the digital signal receiver and the signal certification unit determines the display mode of the LCD monitor according to the control signal and processes the digital image signal according to the display mode to generate an output image signal. The LCD panel which is coupled to the image processor displays the image contents of the output image signal.

According to another embodiment of the claimed invention, a method for automatically switching display mode of a liquid crystal display (LCD) monitor is disclosed. The method includes: receiving a digital image signal; determining if the digital image signal conforms to a protocol and generating a control signal; determining the display mode of the LCD monitor according to the control signal and processing the digital image signal according to the display mode to generate an output image signal; displaying the image contents of the output image signal.

According to another embodiment of the claimed invention, a controller for controlling a display mode of an LCD monitor is disclosed. The controller includes a digital signal receiver, a signal certification unit, and an image processor. The digital signal receiver receives a digital image signal. The signal certification unit, which is coupled to the digital signal receiver, determines if the digital image signal conforms to a protocol and generates a control signal. The image processor, which is coupled to the digital signal receiver and the signal certification unit, determines the display mode of the LCD monitor according to the control signal and processes the digital image signal according to the display mode to generate an output image signal to be displayed on the LCD monitor.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . " Also, the term "couple" is intended to mean either an indirect or direct electrical connection. Accordingly, if one device is coupled to another device, that connection may be through a direct electrical connection, or through an indirect electrical connection via other devices and connections.

At present, more and more digital video/audio equipments (e.g., players, display devices and etc.) have been equipped with a High-Definition Multimedia Interface (HDMI), which was developed recently in response to the requirement of digital transmission and of higher efficiency and transmission rate than the conventional Digital Visual Interface (DVI). In addition, an institution, named Digital Content Protection LLC, has developed a standard, named High-bandwidth Digital Content Protection (HDCP), to protect the copyright of the digital video/audio products from being illegally reproduced and distributed during the transmission and playback of these products. As for the detail standards of the HDCP, please refer to http://www.digital-cp.com.

The HDCP standard has an authentication protocol through which an HDCP transmitter (e.g., a player) determines whether an HDCP receiver (e.g., a display device) is authorized to receive the data or information protected by HDCP. If the HDCP receiver is authorized to receive the data or information protected by HDCP, the data or information protected by HDCP will be sent from the HDCP transmitter to the HDCP receiver via a shared secret key established during the authorization process so as to prevent the protected data or information from being stolen. Because the digital entertainment contents can be effectively protected by the HDCP, more and more entertainment businesses, e.g., the movie industry, take HDCP to protect their products. According to the market tendency, the LCD monitor with HDMI is capable of concluding that the signal sent via the HDCP standard probably contains dynamic image data. Thus the present invention will make use of this fact to solve the problem in prior art.

Figure 1:
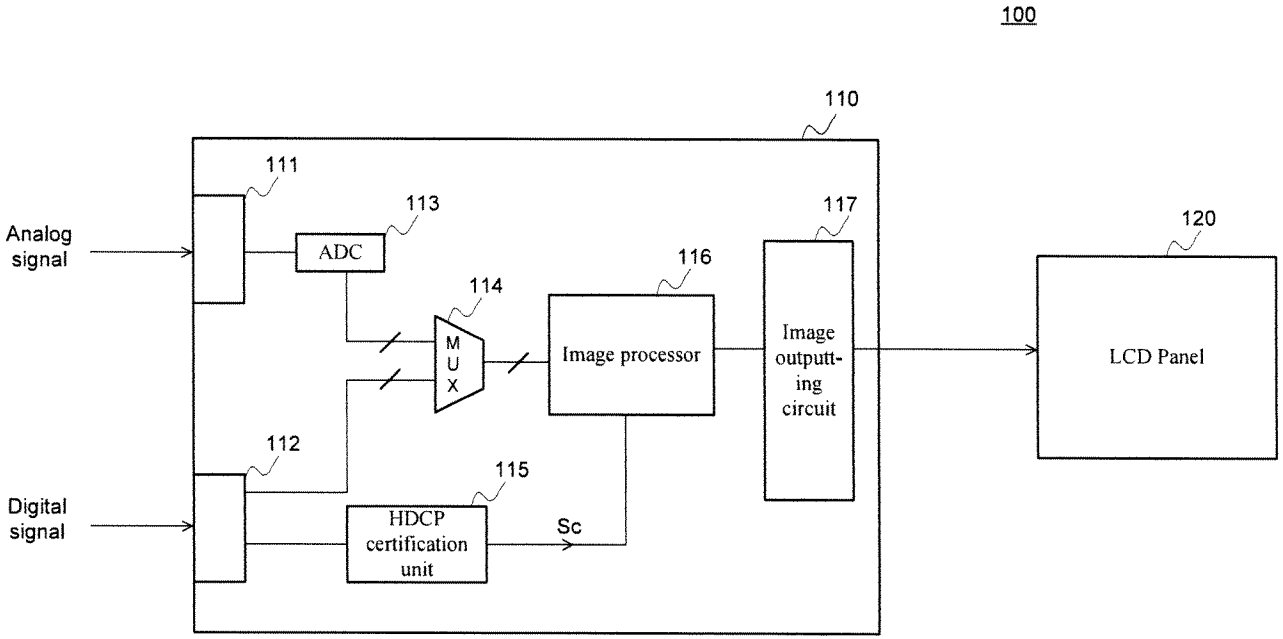
FIG. 1 is a diagram of an LCD monitor capable of automatically switching display mode according to the invention.

Please refer to FIG. 1. FIG. 1 shows a diagram of an LCD monitor capable of automatically switching display mode according to the invention. The LCD monitor 100 includes an LCD controller 110 and an LCD panel 120. The LCD controller 110 includes an analog image signal receiver 111, a digital image signal receiver 112, an Analogy-to-Digital converter (ADC) 113, a multiplexer (mux) 114, an HDCP certification unit 115, an image processor 116, and an image outputting circuit 117.

The analog and digital image signal receivers 111 and 112 are for receiving an analog image signal and a digital image signal respectively. The ADC 113 coupled to the analog image signal receiver 111 and the multiplexer 114 is for transforming the analog image signal, and so the analog image signal is sent in digital format to the multiplexer 114. On the other hand, the digital image signal is sent to both of the multiplexer 114 and the HDCP certification unit 115. Then, the HDCP certification unit 115 determines if the digital image signal conforms to a protocol, more specifically, to an authentication protocol of the HDCP. If the digital image signal conforms to the protocol, the digital image signal is probably a dynamic image signal (e.g., moving pictures and the like), and the LCD monitor 100 would switch to a dynamic image display mode. Furthermore, the HDCP certification unit 115 also generates a control signal Sc to the image processor 116. The image processor 116 coupled to the digital image signal receiver 112 processes the digital image signal according to the control signal Sc and a number of setting values of the display characteristics of the dynamic image display mode. For example, the image processor 116 adjusts the brightness value, the contrast value, the hue value, and the Gamma value of the digital image signal. Alternatively, the image processor 116 further performs an overdrive mechanism, that is, the voltages on the electrodes are adjusted to accelerate the responding speed of the liquid crystal molecules and the image quality of the LCD monitor 100 is therefore enhanced. Afterward, the image outputting circuit 117 determines the signal format (e.g., LVDS, RSDS, and etc.) of the output image signal processed by the image processor 116. Finally, the LCD panel 120 receives the output image signal and displays the contents of the output image signal.

Figure 2:
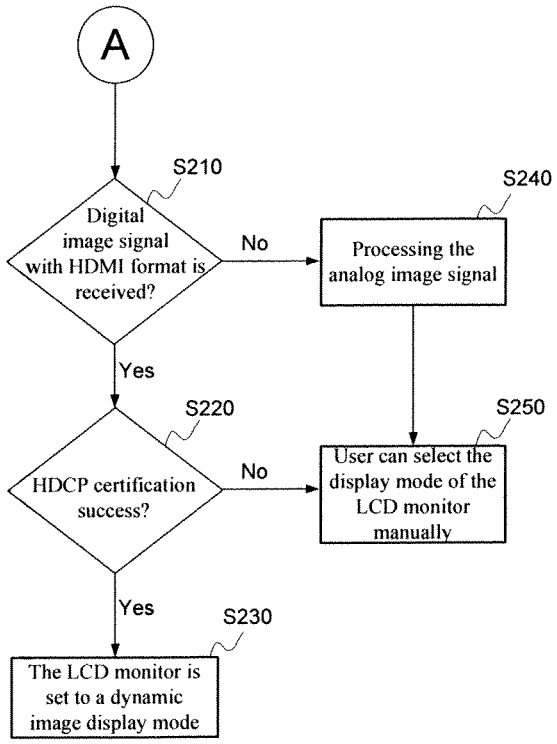
FIG. 2 is a flow chart illustrating the method of automatically switching the display mode of the LCD monitor 100.

Please refer to FIG. 2. FIG. 2 shows a flow chart illustrating the method of automatically switching the display mode of the LCD monitor 100. The LCD monitor 100 capable of automatically switching display mode determines automatically whether a digital image signal with HDMI format is received (S210). If an HDMI-formatted digital image signal is received, the LCD monitor 100 determines whether the digital image signal conforms to an authentication protocol of the HDCP (S220). If the digital image signal conforms to the authentication protocol of the HDCP, the currently transmitted digital image signal is regarded as a dynamic image signal such as a moving picture, and then the display mode of the LCD monitor 100 is switched to a dynamic image display mode (S230). If no digital image signal with HDMI format is received in step S210, then the image processor 116 processes the analog image signal (S240), and users may switch manually the display mode of the LCD monitor 100. Moreover, if the digital image signal does not conform to the authentication protocol of the HDCP in step S220, the currently transmitted digital image signal is regarded as a static image signal, rather than a dynamic image signal, having static image contents such as a picture or a text. As a result, it is not required to automatically switch the LCD monitor 100 to the dynamic image display mode, but instead, other display modes for manual switch are provided (S250).

In summary, using the HDCP to protect digital video/audio contents is a growing tendency in the near future. By determining if the transmission of an image signal is through an authentication protocol of the HDCP, identification on whether the currently transmitted image signal is a dynamic image signal such as a moving picture can be accomplished. Therefore, the LCD monitor can switch automatically to the dynamic image display mode upon a detection of a reception of image signals through the authentication protocol. As a result, users will have no need to switch display mode manually.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display (LCD) monitor, capable of automatically switching display mode, comprising:

a digital signal receiver, for receiving a digital image signal;

a signal certification unit, coupled to the digital signal receiver, for determining if the digital image signal conforms to an authentication protocol and generating a control signal;

an image processor, coupled to the digital signal receiver and the signal certification unit, for determining the display mode of the LCD monitor according to the control signal and processing the digital image signal according to the display mode to generate an output image signal; and an LCD panel, coupled to the image processor, for displaying the image contents of the output image signal;

wherein when the digital image signal conforms to the authentication protocol, the LCD monitor switches to a dynamic image display mode, and the image processor performs an overdrive mechanism on the digital image signal according to the control signal, so as to overdrive the LCD monitor.

2. The LCD monitor of claim 1, further comprising:

an analog signal receiver, for receiving an analog image signal; and an analog-to-digital converter, coupled to the analog signal receiver and the image processor, for transforming the analog image signal into digital format and sending the digital-formatted image signal to the image processor.

3. The LCD monitor of claim 1, wherein the display mode specifies the setting values of a plurality of display characteristics of the LCD monitor, and the display characteristics comprise a brightness value, a contrast value, a hue value, and a Gamma value.

4. A method for automatically switching a display mode of a liquid crystal display (LCD) monitor, the method comprising:

receiving a digital image signal;

determining if the digital image signal conforms to a protocol and generating a control signal;

determining the display mode of the LCD monitor according to the control signal and processing the digital image signal according to the display mode to generate an output image signal;

displaying the image contents of the output image signal; and switching the LCD monitor to a dynamic image display mode and performing an overdrive mechanism on the digital image signal according to the control signal, so as to overdrive the LCD monitor when the digital image signal conforms to the protocol.

5. The method of claim 4, further comprising:

receiving an analog image signal; and transforming the analog image signal into digital format and processing the digital-formatted image signal.

6. The method of claim 4, wherein the display mode specifies the setting values of a plurality of display characteristics of the LCD monitor, and the display characteristics comprise a brightness value, a contrast value, a hue value, and a Gamma value.

7. A controller for controlling a display mode of an LCD monitor, comprising:

a digital signal receiver, for receiving a digital image signal;

a signal certification unit, coupled to the digital signal receiver, for determining if the digital image signal conforms to a protocol and generating a control signal; and an image processor, coupled to the digital signal receiver and the signal certification unit, for determining the display mode of the LCD monitor according to the control signal and processing the digital image signal according to the display mode to generate an output image signal to be displayed on the LCD monitor;

wherein when the digital image signal conforms to the protocol, the image processor performs an overdrive mechanism on the digital image signal according to the control signal.

8. The controller of claim 7, further comprising:

an analog signal receiver, for receiving an analog image signal; and an analog-to-digital converter, coupled to the analog signal receiver and the image processor, for transforming the analog image signal into digital format and sending the digital-formatted image signal to the image processor.

9. The controller of claim 7, wherein the display mode specifies the setting values of a plurality of display characteristics of the LCD monitor, and the display characteristics comprise a brightness value, a contrast value, a hue value, and a Gamma value.

10. The controller of claim 7, further comprising:

an image outputting circuit, coupled to the imaging processor, for determining the signal format of the output image signal.

* * * * *